US005118263A

United States Patent [19]

Fritchman

[11] Patent Number: 5,118,263

[45] Date of Patent: Jun. 2, 1992

[54] HERMETIC REFRIGERATION COMPRESSOR

[76] Inventor: Jack F. Fritchman, 926 Brentwood Dr., Cullman, Ala. 35055

[21] Appl. No.: 516,102

[22] Filed: Apr. 27, 1990

[51] Int. Cl.[5] ..... F04B 35/04; F04B 15/08; F01B 31/10; F16N 1/00

[52] U.S. Cl. ..... 417/415; 417/901; 92/158; 92/159; 92/160; 184/6.8; 184/18

[58] Field of Search ..... 417/901, 415; 92/158, 92/159, 160; 184/6.8, 18

[56] References Cited

U.S. PATENT DOCUMENTS 2,100,799 11/1937 Drysdale .
2,286,272 6/1942 Higham .
2,360,876 10/1944 Hvid .
2,583,583 1/1952 Mangan .
2,797,857 7/1957 Warner .
3,497,135 2/1970 Gannaway ..... 417/415
3,563,677 2/1971 Retan ..... 417/415
4,718,830 1/1988 Middleton et al. ..... 417/415
4,784,581 11/1988 Fritchman .

*Primary Examiner*—Richard A. Bertsch
*Assistant Examiner*—Alfred Basichas
*Attorney, Agent, or Firm*—Pearne, Gordon, McCoy & Granger

[57] ABSTRACT

A single horizontal cylinder, small refrigeration compressor has a lubrication arrangement which includes a recess on the cylinder block above the cylinder bore which collects oil that drains from the lower end of the motor. A supply passage extends downward from said recess and opens into the cylinder bore near its midpoint. The piston has an elongated shallow groove on the interior between head and skirt lands which is connected to the passage during a major portion of the piston stroke to receive oil from the recess. Drain passage means are provided on the piston to allow oil to flow out of the groove at a lesser rate than it is supplied by the supply passage from the recess.

10 Claims, 4 Drawing Sheets

HERMETIC REFRIGERATION COMPRESSOR

BACKGROUND OF THE INVENTION

This invention relates generally to hermetic refrigeration compressors of the type generally used in household appliances, and more particularly to a lubrication arrangement for the piston and cylinder for single piston, horizontal cylinder reciprocating compressors.

Reciprocating piston refrigeration compressors used for household appliances such as refrigerators and freezers utilize a single piston and cylinder arrangement, usually operating in a horizontal plane, and are powered by relatively low horsepower, two-pole electric motors generally in the range of a maximum of Δ horsepower down to as low as 1/6 horsepower to cover the range from the smallest to the largest household refrigerators. Because of this variation in size, it is necessary for the manufacturer to provide a series of sizes for the compressors which requires not only a variation in the horsepower of the electric motor, but also a variation in the piston displacement. For reasons of manufacturing economy, while it is possible to change the displacement by varying the bore diameter of the cylinder, it is generally preferred to vary the displacement by changing the length of stroke, since this allows the use of identically machined cylinder blocks, requiring only a change in the crankshaft and piston to vary from one size to another. Furthermore, such compressors generally have a bore which is notably greater in diameter than the length of the piston stroke, not only because of a desire to keep the piston velocity relatively low but also to provide sufficient bore area for the suction and discharge valves, which are generally of the reed-type and located on a valve plate which closes off the end of the cylinder.

In order to ensure long life for the compressor, as well as to improve efficiency by reducing friction, it has long been recognized that lubrication of the moving parts of the compressor is very important. Thus hermetic reciprocating piston compressors of this type are provided with a supply of lubricating oil in a reservoir in the bottom of the casing. The bottom end of the vertical axis crankshaft extends downward into this reservoir, where it is configured to provide a pumping action either by means of the use of centrifugal force or some form of more positive displacement, such as a screw action, to force the oil in the reservoir upward through internal passages in the crankshaft to provide lubrication for the crankshaft bearings as well as the bearing for the connecting rod. Generally, in a motor up configuration, as described in the invention, excess oil is allowed to exit from the upper end of the bearing boss where it lubricates the vertical thrust bearing as well as cooling the motor before draining back into the reservoir. In an inverted (motor down) configuration, the excess oil is usually allowed to exit from the upper end of the crankshaft to spray over the interior of the compressor casing. It is also recognized that the connecting rod should be drilled to allow oil to flow from the connecting rod bearing up to the wrist pin bearing to ensure proper lubrication at this point. Further lubrication may be provided by a capillary tube having one end immersed in the oil reservoir and the other end opening into the suction plenum in the cylinder head adjacent the valve plate and the suction valve to ensure that a small amount of lubricating oil passes the suction valve into the upper end of the piston and cylinder.

Generally, it has been found undesirable to use sealing rings on the piston because of problems with increased friction and wear. Therefore, with the usual construction, the piston is carefully machined over all of the external wall surface to a very fine finish, and the tolerances of the fit in the cylinder are held to a very small amount, and this clearance is generally so low that the pistons and cylinder bores must both be carefully gauged and matched to a selected fit during assembly. This fit is sufficient to hold a thin oil film between the surface of the piston and the cylinder bore to provide adequate lubrication and to prevent any blow-by past the piston on the compression stroke.

It has therefore been recognized as desirable to provide additional oiling for the cylinder wall and the wrist pin area. While lubrication of the wrist pin can be obtained by a drilled passage in the connecting rod directly from the connecting rod bearing, various arrangements have been proposed to supply lubricating oil directly to the cylinder bore. For example, W. D. Drysdale U.S. Pat. No. 2,100,799, issued Nov. 30, 1937, shows a vertical cylinder bore compressor in which a slinger ring is mounted on the crankshaft and a pair of inclined openings are provided in the cylinder wall which become aligned with the hollow wrist pin at bottom dead center, so that oil is supplied to the interior of the wrist pin, and presumably also the cylinder wall. Other arrangements are found in horizontal cylinder compressors such as shown in W. W. Higman U.S. Pat. No. 2,286,272, issued Jun. 16 1942, and M. Y. Warner U.S. Pat. No. 2,797,857, issued Jul. 2, 1957. Both of these compressors disclose a vertical passage opening into the cylinder bore in alignment with the piston which receives oil from a reservoir formed in the cylinder block above the cylinder. In both of these patents, it is presumed that the oil will flow into the interior of the wrist pin, and thereby provide lubrication to the cylinder bore and piston.

Another cylinder bore lubrication arrangement is shown in R. M. Hvid U.S. Pat. No. 2,360,876, issued Oct. 24, 1944. This patent shows a refrigeration compressor having a single inverted vertical cylinder in which the piston is reciprocated by a connecting rod which has a ball joint connection to an eccentric rotating plate. With this arrangement, the piston not only reciprocates, but also rotates once around its axis for each reciprocation. To provide the increased lubrication required by this movement, an annular groove is formed in the cylinder wall near the midpoint of the piston at the top of the stroke, and oil is supplied to this groove through a pumping arrangement.

A more recent approach is shown in J. R. Mangan U.S. Pat. No. 2,583,583, issued Jan. 29, 1952. This compressor has a horizontal cylinder with aligned openings at the top and bottom adjacent the midpoint of the cylinder. The piston has an annular groove around its outer periphery which comes into alignment with the top and bottom openings at bottom dead center so that the oil can enter the groove from the top and the excess will flow out through the bottom opening at bottom dead center on each piston reciprocation.

While the prior art shows various arrangements for admitting oil to a portion of the cylinder bores, the oil is supplied only to limited areas of the bore and piston surfaces, and therefore optimum piston and cylinder lubrication is not accomplished.

SUMMARY OF THE INVENTION

The present invention provides improved piston and cylinder lubrication that is preferably used in combination with previously used lubrication arrangements to obtain an optimum result. According to the preferred embodiment of this invention, the refrigeration compressor is of the type having a single horizontal cylinder mounted below the electric drive motor immediately above the oil reservoir. An angled tube projects below the lower end of the crankshaft into the oil reservoir, and because the tube has a sloping portion extending outward from the center of rotation, the centrifugal force picks up oil from the reservoir for distribution through the crankshaft in a manner well known in the art. At the connecting rod bearing, the aluminum connecting rod has a drilled passage between the crankshaft journal and the wrist pin journal so that oil supplied to the connecting rod bearing on the crankshaft travels through this passage to supply the wrist pin, which has an annular groove in this zone to ensure positive distribution of the oil around the circumference of the wrist pin. Further lubrication is obtained by the use of a suction capillary tube having the end extending below the oil reservoir and passing up to the cylinder head, where it enters into the suction chamber adjacent the suction valve to provide a controlled oil flow to the suction valve so that oil passes into the interior of the cylinder at the head end of the piston. Such an arrangement for the capillary tube is shown in the present inventor's U.S. Pat. No. 4,784,581, issued Nov. 15, 1988 and assigned to the same assignee as the present invention.

According to the preferred embodiment of the present invention, the lubrication of the piston and cylinder is improved by an additional lubrication arrangement in addition to the previously used arrangements described hereinabove. According to the present invention, the cylinder block is formed with a recess or pocket directly above the cylinder and open to receive lubricating oil that drains from the lower end of the motor. At the bottom of this pocket or reservoir is a vertical passage opening into the cylinder bore adjacent the midpoint thereof. The piston is formed with an elongated annular groove in the midpoint in the area of the wrist pin, so that the piston now, in effect, has two separate lands on the side wall, one each adjacent the head and the skirt, which make normal bearing contact with the cylinder wall with a minimum clearance fit. The annular groove is made to have preferably a fixed depth between the ends and the front end is positioned so that the groove will be in contact with the oil passage in the cylinder block during bottom dead center and at most of the portions of the piston stroke. The land on the skirt will cover the oil passage while the piston is near top dead center and the bottom edge of the skirt will pass the hole to allow a certain amount of oil to pass directly into the cylinder bore behind the piston.

The connection between the annular groove and the oil passage ensures that at all times it will remain full of lubricating oil to ensure a more positive supply of oil to the cylinder walls as the piston reciprocates. Furthermore, the fact that the piston now makes close sliding contact along a lesser axial extent of its side wall. i.e., only at the head and skirt lands, sliding friction is further decreased. The presence of the larger amount of oil in this groove also tends to provide a better seal against piston blow-by as may occur near the end of the compression stroke. It should be noted that when the piston is in this range near top dead center, where blow-by is most likely to occur, the oil supply hole is cut off by the skirt land to prevent any possible exit of compressed gases into the supply reservoir possible exit of compressed gases into the supply reservoir on the cylinder block.

To further ensure the continued supply and circulation of oil, the piston has one or two drain or vent openings extending radially inward from the groove into the hollow interior of the piston at a point away from the wrist pin to ensure that oil can flow out of the annular groove into the hollow piston interior and thence around the connecting rod into the previously mentioned reservoir in the bottom of the casing. Since this vent opening is always open and unrestricted, any blow-by gases that get past the land at the piston head enter the groove and flow with the oil out through the oil drain passage in the piston and cannot flow back through the supply opening, which, as previously stated is closed off by the skirt land near top dead center.

It has been found that when the piston and cylinder lubrication of the present invention is added to a compressor, increases in compressor operating efficiency have been obtained as measured by the efficiency ratio (EER) in BTU/watt hour.

DETAILED DESCRIPTION OF THE PREFERRED EMBODIMENTS

Figure 1:
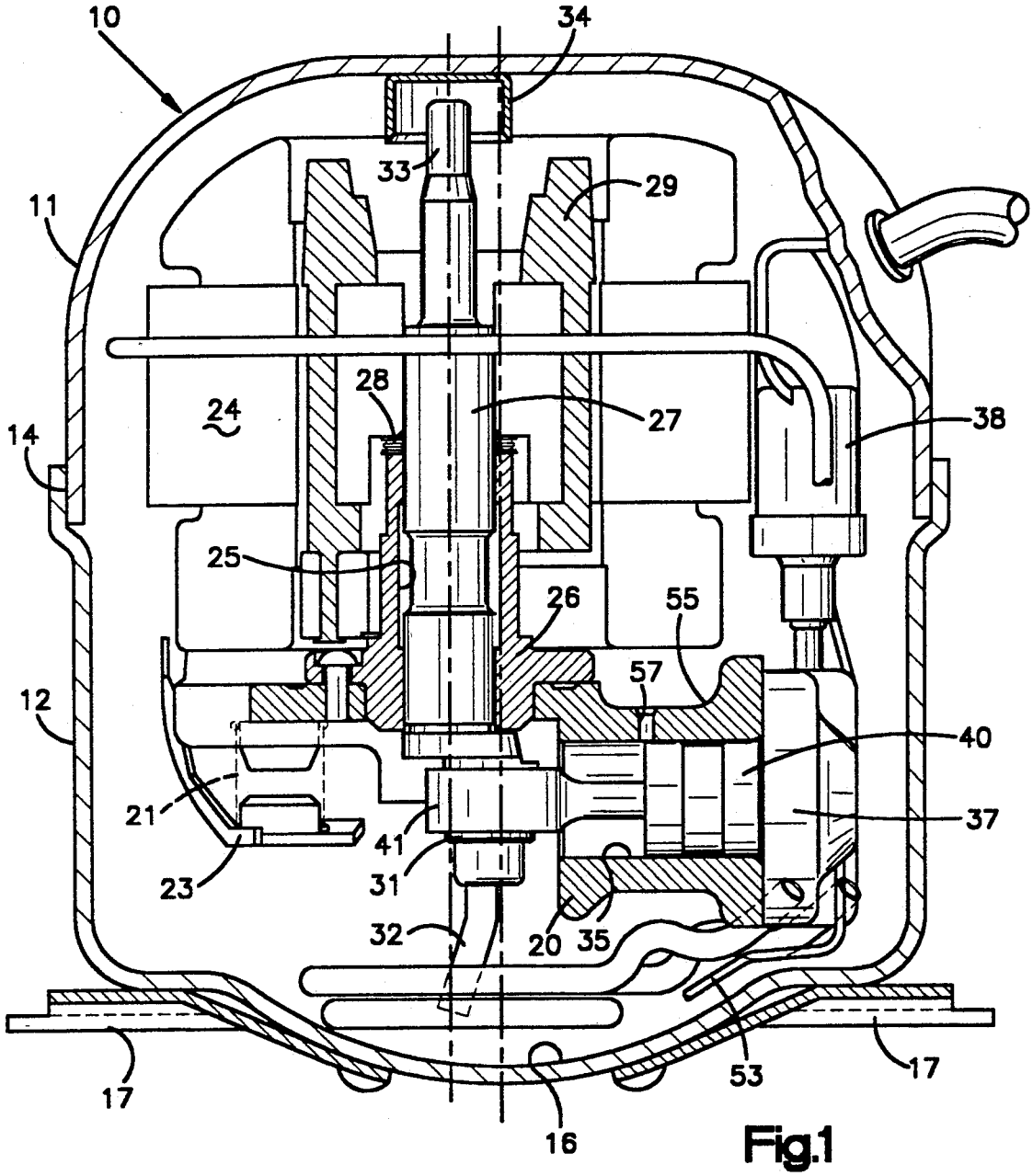
FIG. 1 is a side elevational view, partly in section, of a hermetic refrigeration compressor incorporating the present invention.

Referring now to the figures in greater detail, FIG. 1 shows a vertical section through a small single cylinder hermetic refrigeration compressor of the type commonly used for household refrigerators and food freezers. The compressor includes a shell 10 comprising an upper half 11 and lower half 12 which are joined together along a joint indicated at 14 to provide a hermetic enclosure for the internal compressor mechanism. It should be noted that the lower half 12 includes a depressed oil reservoir section 16 at the center, and it also has mounting feet 17 welded to the outside for mounting the compressor through rubber bushings and suitable frame members of the refrigerator or food freezer.

The internal pumping mechanism includes a cylinder block 20 which is resiliently mounted within the shell 10 by suitable means such as spring 21 secured to the underside of the cylinder block 20 and engaging a projecting spring support 23 welded on the inside of the lower shell half 12. It will be understood that the spring supports are three or four in number and are so positioned and constructed to support the pump mechanism in both the stationary and running positions.

A motor stator 24 is bolted or otherwise securely fastened on the upper side of the cylinder block 20, which also has secured to it at the center a bearing boss 26, which may either be integral or a separate member as shown. The bearing boss 26 has a vertically extending bore 25 therein which serves to journal a vertically extending crankshaft 27. Above the bearing boss 26 a rotor 29 is press-fitted on the end of crankshaft 27 to rotate within the stator 24, and the rotor 29 includes a thrust bearing 28 engaging the upper end of the bearing boss 26 to absorb the vertical loads and weight of the rotor 29 and crankshaft 27.

At its lower end, crankshaft 27 has an offset crank pin 31, and at its bottom end is an angularly extending oil pickup tube 32 extending angularly from the offset crank pin 31 to have a lower end submersed in the oil reservoir 16 and located on the axis of rotation of crankshaft 27. Thus, the oil pickup tube 32, because of the portion extending at an angle upwardly and away from the axis of rotation, serves as a centrifugal pump to force oil from the oil reservoir 16 up into the interior of the crankshaft 27 through various internal passages (not shown) which provide oil to the surface of the crank pin 31 and the bearings in the bearing boss 26. It will be understood that the top end 33 of crankshaft 27 extends upward above the rotor 29 and stator 24 to fit within an inverted cup 34 secured to the inside of the shell upper half 11. The cup 34 normally has a substantial clearance from the crankshaft end 33, but does serve as a restraint to movement of the entire assembly on the support springs 21 during shipping.

Figure 2:
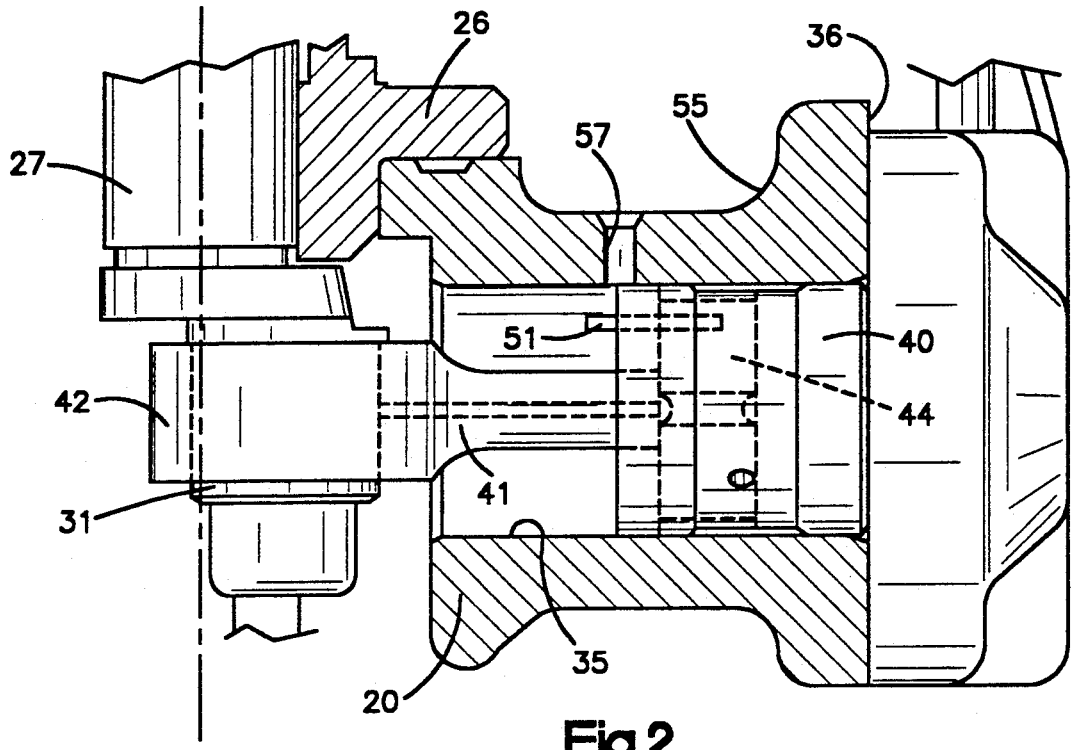
FIG. 2 is an enlarged, fragmentary view of the piston and cylinder portion of the compressor shown in FIG. 1, with the piston in the top dead center position.
Figure 3:
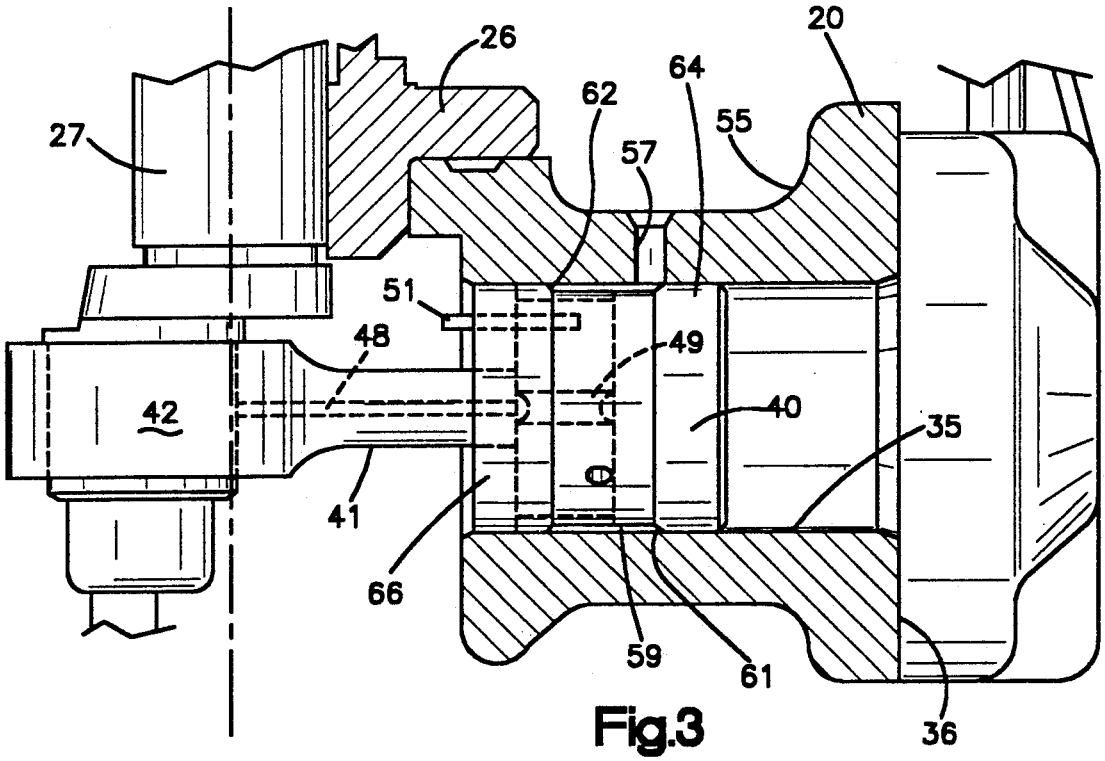
FIG. 3 is a fragmentary, elevational view similar to FIG. 2, but showing the piston at the bottom dead center position resulting from the longest stroke.

In alignment with the crank pin 31, the cylinder block 20 has a cylinder bore 35 extending away from the crank pin 31 and opening onto an end face 36 of the cylinder block, which is closed off by means of a cylinder head 37 including a suction muffler 38 and a valve plate (not shown) for mounting the valve structures for providing the necessary suction and discharge valves for the compressor in the manner well known in the art. The pumping action is provided by a piston 40 slidably mounted within the cylinder bore 35, and a connecting rod 41 has a big end 42 journaled on the crank pin 31 and the opposite end connected to a wrist pin 44 mounted in the transverse bore 46 in the piston 40. As shown in FIGS. 2 and 3, there is a longitudinal oil passage 48 in the connecting rod 41 extending from the big end 42 to the wrist pin 44 for conducting oil from the crank pin 31 to the wrist pin 44, where the oil may be distributed around an annular groove 49 formed in the middle of wrist pin 44. Wrist pin 44 is nonrotatably held in the transverse bore 46 by a suitable lock pin 51 extending through the piston 40 and into an opening provided on the wrist pin. It will be understood that the above-described structure is conventional and well known in the art, and the above description serves primarily as background for the following description of the preferred embodiment of the present invention.

An oil film must be present between the piston 40 and cylinder bore 35 not only to provide lubrication between these parts as the piston moves back and forth in the cylinder, but also to provide sealing action to prevent blow-by of the refrigerant gas being compressed back past the piston into the space within the shell 10. Heretofore, the oil has been supplied to the walls of cylinder bore 35 and the surface of piston 40 from several sources. The first of these is the flow of oil around the wrist pin 44 as supplied through the oil passage 48 along the sides of the transverse bore 46 to flow out the ends of the bore and to the walls of the cylinder bore 35. It has generally been found that the amount of oil supplied to the walls of cylinder bore 35 from this source is rather small because of the generally tight fit between the wrist pin 44 and transverse bore 46. A main source of oil to the head end of cylinder bore 35 is through the oil that is mixed with the returning refrigerant gas and passes into the suction muffler 38, from which the oil can pass into the cylinder on its suction stroke past the suction valve (not shown). Another source of oil for the skirt end of the piston and cylinder bore is the oil that leaks out of the joint between the big end 42 of connecting rod 41 and the crank pin 31, and therefore flies off by centrifugal force, with some of the oil landing within the lower end of cylinder bore 35 when the piston is on the forward stroke. In addition to the above, some compressors have been supplied with oil suction tubes, such as that shown at 53 (see FIG. 1). A small capillary tube has one end immersed in the oil reservoir 16 and has the other end entering into the suction plenum to provide additional oil which enters the cylinder bore through the suction valve. The presence of oil in the cylinder head area is particularly important not only to supply oil to the cylinder bore, but also to provide lubrication to the suction and discharge valves as well as to provide a flow of cooling oil to these areas, which become heated from the compressed refrigerant gases particularly in the areas of the discharge valve and discharge plenum within the cylinder head 37.

In accordance with the present invention, advantage is taken of the fact that there is a certain amount of oil flowing from the upper end of the bearing boss. Accordingly, an oil supply recess 55 is located on the cylinder block 20 directly above the cylinder bore 35, and a certain amount of oil from the bearing boss will flow downward off the motor stator 24 into the oil recess 55, where it normally tends to accumulate. An oil feed hole 57 is provided in the form of a small vertical bore extending through the cylinder block 20 from the oil supply recess 55 into the cylinder bore 35 adjacent its midpoint. The piston 40 has a circular side wall which is provided with an elongated annular oil groove 59 which is of only slightly reduced diameter defining a cylindrical surface having a head edge 61 adjacent the cylinder head 37 and a skirt edge 62 adjacent the crankshaft 27. The groove 59 has a depth of only about 0.010 to 0.020 inch and the edges 61 and 62 are provided with filets and radiuses to avoid any burrs and sharp edges. The spacing between the edges 61 and 62 is preferably such as to provide a maximum groove width while also providing adequate load support area, and therefore leaves a head land 64 at the top end of piston 40 adapted to make a tight sliding fit within the cylinder bore, as well as a skirt land 66 at the bottom end of the piston. As shown at FIGS. 2 and 3, it can be seen that the oil groove 59 and the oil feed hole 57 are so positioned that at bottom dead center of the piston, as shown in FIG. 3, the head land 64, depending on the length of the piston stroke, may partly, but never completely, block the oil hole 57, so that substantially all of the area of the head land 64 is available to provide a sealing fit with the cylinder bore 35 as the piston begins it compression stroke. On the other hand, when the piston is at top dead center, as shown in FIG. 2, it is desirable, but not necessary, that the skirt land 66 be positioned to slightly uncover a portion of the oil feed hole 57 to allow additional oil to drip into the cylinder bore 35 to ensure adequate lubrication in the area of the skirt land 66 during reciprocation of the piston.

It will therefore be seen that the presence of the oil at the midportion of the cylinder bore 35 through the oil feed hole 57 provides an additional oil supply in this area to ensure better sealing and better lubrication of the piston at the head and skirt lands 64 and 66, and, because of the reduced area on the piston in contact with the cylinder bore, friction is slightly reduced.

Figure 4:
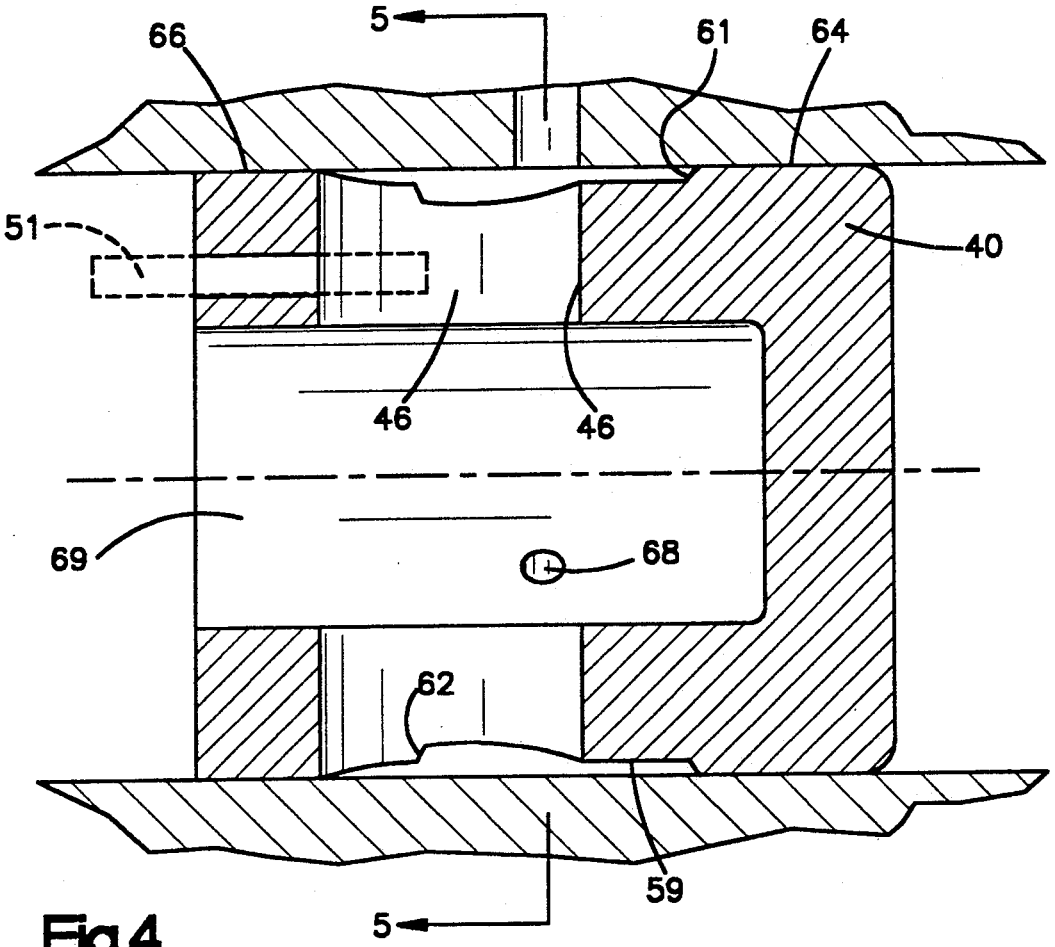
FIG. 4 is a further enlarged, fragmentary cross-sectional view of the piston and cylinder with the connecting rod and wrist pin removed and with the piston in an intermediate position between top and bottom dead centers.
Figure 5:
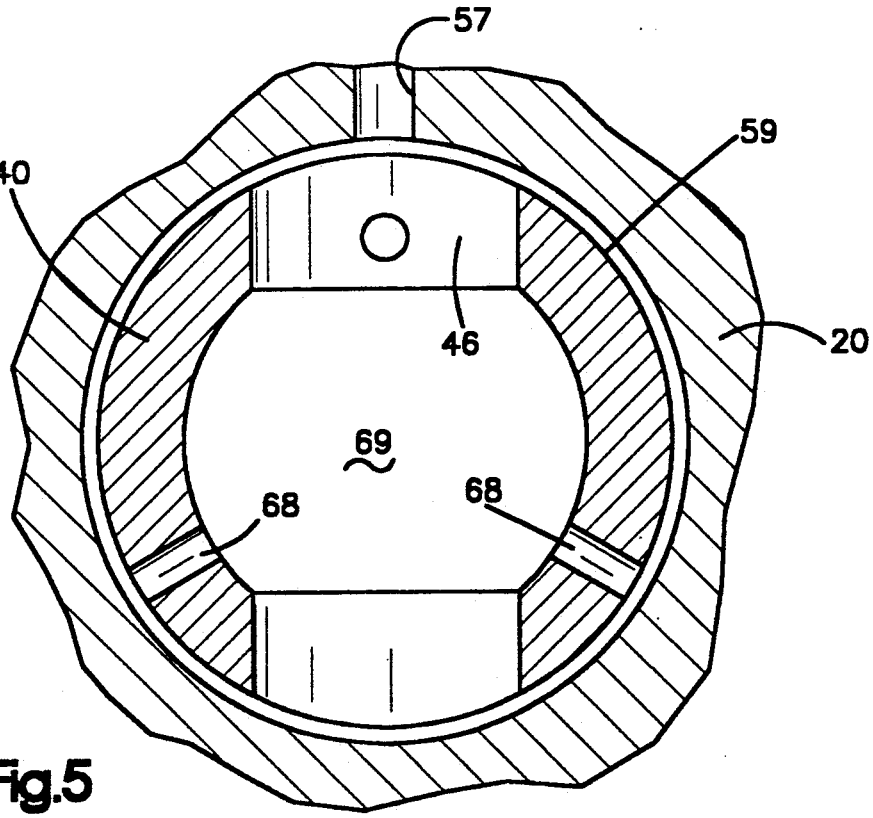
FIG. 5 is a cross-sectional view taken on line 5—5 of FIG. 4.

According to another feature of the present invention, to ensure positive supply of fresh oil through the feed hole 57, means are provided for oil within the oil groove 59 to escape from the groove 59 to ensure a constant positive flow of oil in this area and to provide better cooling. As shown in FIGS. 4 and 5, this may be accomplished by the use of passage means in the form of bleed holes 68, which may be one or two in number, extending inwardly through the piston from the oil groove 59 into the interior cavity 69. The total area of the bleed hole or holes 68 is such as to provide a reduced flow rate into the interior cavity 69 below the flow rate of the oil that can be admitted through the oil feed hole 57 to ensure that the oil groove 59 is always maintained full of oil at all times, for improved cooling and sealing of the area between the piston 40 and cylinder bore 35.

Figure 6:
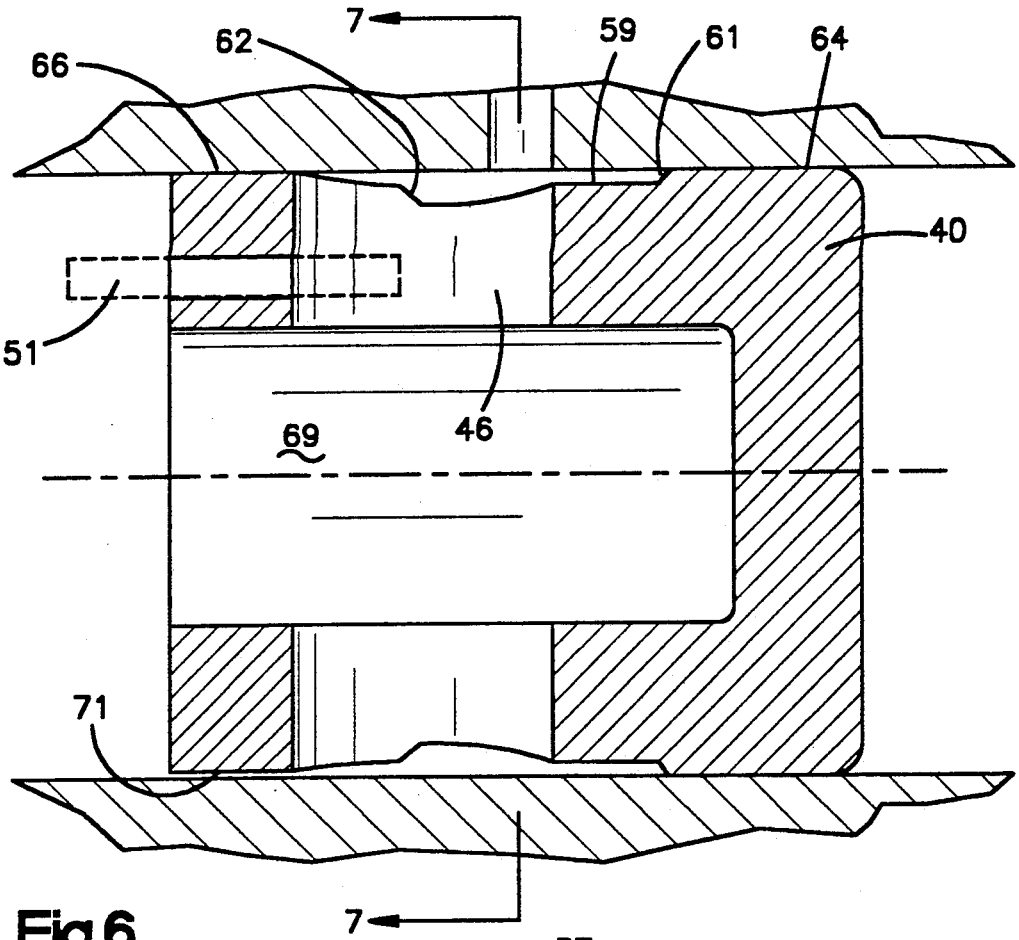
FIG. 6 is a view similar to FIG. 4 but showing another embodiment of the invention.
Figure 7:
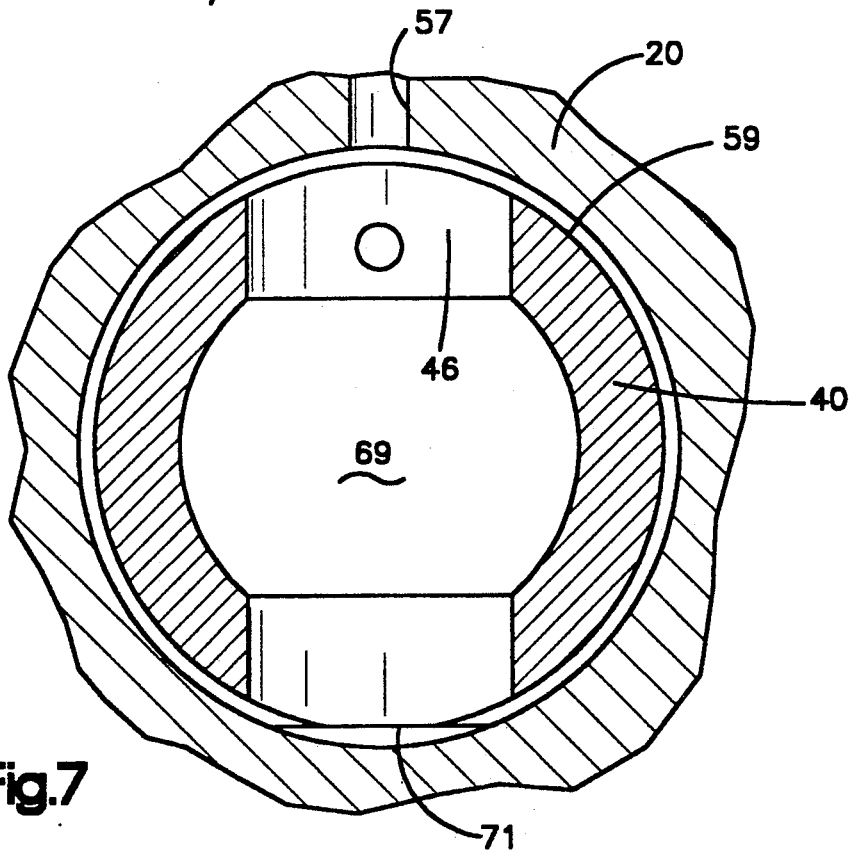
FIG. 7 is a cross-sectional view taken on line 7—7 of FIG. 6.

As an alternative arrangement, as shown in FIGS. 6 and 7, instead of the use of a bleed hole 68, it is possible to provide a passage in the form of a small flat or groove 71 on the skirt land 66 to allow oil to flow from the oil groove 59 past the skirt land 66 into the lower end of cylinder bore 35. Again, the size of the flat 71 must be such that the outflow past the flat 71 can never be as great as the inflow rate through the feed hole 57 to ensure that the oil groove 59 remains full of oil at all times during operation of the compressor.

Although several preferred embodiments of this invention have been shown and described in detail, it is recognized that these are by way of example only, and various modifications and rearrangements may be resorted to without departing from the scope of the invention as defined in the claims.

What is claimed is:

1. A refrigeration compressor comprising a shell, a cylinder block mounted inside said shell, a crankshaft journaled on said cylinder block for rotation about a vertical axis, electric motor means on said cylinder block for rotatably driving said crankshaft a horizontal cylinder bore in said cylinder block, a piston slidably mounted in said cylinder bore, said piston having a cylindrical side wall in sealing contact with said bore, said side wall including a head end at the end away from said crankshaft and a skirt end at the end adjacent said crankshaft, drive means interconnecting said crankshaft and said piston and operable to reciprocate said piston in said bore in response to rotation of said crankshaft to define a stroke length of said piston, said piston side wall having an annular groove adjacent its midpoint between said head end and said skirt end, an oil supply passage opening into said bore at a point intermediate the ends of said bore and at the uppermost point, said groove being of uniform depth and having an axial length long enough to be in communication with said oil supply passage during a major portion of said stroke.

2. A refrigeration compressor comprising a shell, a cylinder block mounted inside said shell, a crankshaft journaled on said cylinder block for rotation about a vertical axis, electric motor means on said cylinder block for rotatably driving said crankshaft, a horizontal cylinder bore in said cylinder block, a piston slidably mounted in said cylinder bore, said piston having a cylindrical side wall in sealing contact with said bore, said side wall including a head end at the end away from said crankshaft and a skirt end at the end adjacent said crankshaft, drive means interconnecting said crankshaft and said piston and operable to reciprocate said piston in said bore in response to rotation of said crankshaft to define a stroke length of said piston, said piston side wall having an annular groove adjacent its midpoint between said head end and said skirt end, an oil supply passage opening into said bore at a point intermediate the ends of said bore and at the uppermost point, said groove having an axial length long enough to be in communication with said oil supply passage during a major portion of said stroke, and passage means on said piston allowing oil in said groove to drain into said cylinder bore at said skirt end of said piston.

3. A refrigeration compressor as set forth in claim 2, wherein said passage means is a flat formed on the land at said skirt end.

4. A refrigeration compressor as set forth in claim 2, wherein said groove is of uniform depth.

5. A refrigeration compressor as set forth in claim 2, wherein said oil supply passage also opens at its upper end into an oil supply recess located on said cylinder block.

6. A refrigeration compressor comprising a shell, a cylinder block mounted inside said shell, a crankshaft journaled on said cylinder block for rotation about a vertical axis, electric motor means on said cylinder block for rotatably driving said crankshaft, a horizontal cylinder bore in said cylinder block, a piston slidably mounted in said cylinder bore, said piston having a cylindrical side wall and a hollow interior, said side wall terminating in a head end at the end away from said crankshaft and in a skirt end at the end adjacent said crankshaft, drive means interconnecting said crankshaft and said piston and operable to reciprocate said piston in said bore in response to rotation of said crankshaft to define a stroke length of said piston, said piston side wall having an annular recessed groove adjacent its midpoint and spaced from both the head end and skirt end, said piston side wall at said skirt end and at said head end being in sealing contact with said cylinder bore, an oil supply passage opening into said bore at a point intermediate the ends of said bore and at the uppermost point, said groove having an axial length long enough to be in communication with said oil supply passage during a major portion of said stroke, and oil drain passage means in said piston from said groove into said hollow interior.

7. A refrigeration compressor as set forth in claim 6, wherein said groove is of uniform depth.

8. A refrigeration compressor as set forth in claim 6, wherein said oil drain passage means has an effective cross-sectional area less than that of said oil supply passage.

9. A refrigeration compressor as set forth in claim 8, wherein said oil drain passage means comprises a pair of openings extending from said groove into said hollow interior.

10. A refrigeration compressor as set forth in claim 6, wherein said oil supply passage opens at its upper end into an oil supply recess located on said cylinder block above said cylinder bore.

* * * * *